US008087454B2

(12) United States Patent
Kerber et al.

(10) Patent No.: US 8,087,454 B2
(45) Date of Patent: Jan. 3, 2012

(54) ROLLED HEAT EXCHANGE

(75) Inventors: Christiane Kerber, Pöcking (DE); Helmut Kreis, München (DE); Anton Moll, Raisting (DE); Manfred Steinbauer, Raisting (DE)

(73) Assignee: Linde Aktiengesellschaft, Munich (DE)

( * ) Notice: Subject to any disclaimer, the term of this patent is extended or adjusted under 35 U.S.C. 154(b) by 135 days.

(21) Appl. No.: 11/574,184

(22) PCT Filed: Aug. 4, 2005

(86) PCT No.: PCT/EP2005/008473

§ 371 (c)(1), (2), (4) Date: Aug. 20, 2007

(87) PCT Pub. No.: WO2006/021315

PCT Pub. Date: Mar. 2, 2006

(65) Prior Publication Data

US 2008/0115918 A1 May 22, 2008

(30) Foreign Application Priority Data

Aug. 24, 2004 (DE) ..... 10 2004 040 974

(51) Int. Cl.
*F28D 5/02* (2006.01)

(52) U.S. Cl. ..... 165/115; 165/163

(58) Field of Classification Search ..... 165/115, 165/117, 163

See application file for complete search history.

(56) References Cited

U.S. PATENT DOCUMENTS

| | | | | | |
|---|---|---|---|---|---|
| 2,639,947 | A | * | 5/1953 | Schaub et al. | 239/500 |
| 2,737,789 | A | * | 3/1956 | Ruff | 62/305 |
| 3,385,352 | A | * | 5/1968 | Engalitcheff, Jr. et al. | 165/60 |
| 3,666,423 | A | * | 5/1972 | Muenger | 422/200 |
| 4,579,647 | A | * | 4/1986 | Smith | 208/111.01 |
| 4,632,787 | A | * | 12/1986 | Tippmann | 261/30 |
| 4,764,254 | A | * | 8/1988 | Rosenblad | 162/249 |
| 4,788,040 | A | * | 11/1988 | Campagnolo et al. | 422/220 |
| 4,932,468 | A | * | 6/1990 | Ayub | 165/118 |
| 4,969,507 | A | * | 11/1990 | Rosenblad | 165/115 |
| 5,176,161 | A | * | 1/1993 | Peters et al. | 137/15.08 |
| 5,501,079 | A | | 3/1996 | Kreis et al. | |
| 5,849,148 | A | * | 12/1998 | Walker | 159/13.2 |
| 6,253,571 | B1 | * | 7/2001 | Fujii et al. | 62/484 |

FOREIGN PATENT DOCUMENTS

| | | | |
|---|---|---|---|
| DE | 22 37 241 | A1 | 2/1974 |
| DE | 28 35 334 | A1 | 2/1980 |
| DE | 2835334 | A * | 2/1980 |

* cited by examiner

*Primary Examiner* — Allen Flanigan

(74) *Attorney, Agent, or Firm* — Millen, White, Zelano & Branigan, P.C.

(57) ABSTRACT

The invention relates to a rolled heat exchanger with several pipes that are wound around a central pipe, with a casing that delimits an external space around the pipes and with a liquid distributor for distributing liquid in the external space. According to the invention, the liquid distributor is designed as a pipe manifold that has a main channel (21) and several distributing arms (22) that are flow-connected to the main channel (21).

10 Claims, 4 Drawing Sheets

ROLLED HEAT EXCHANGE

Figure 1:
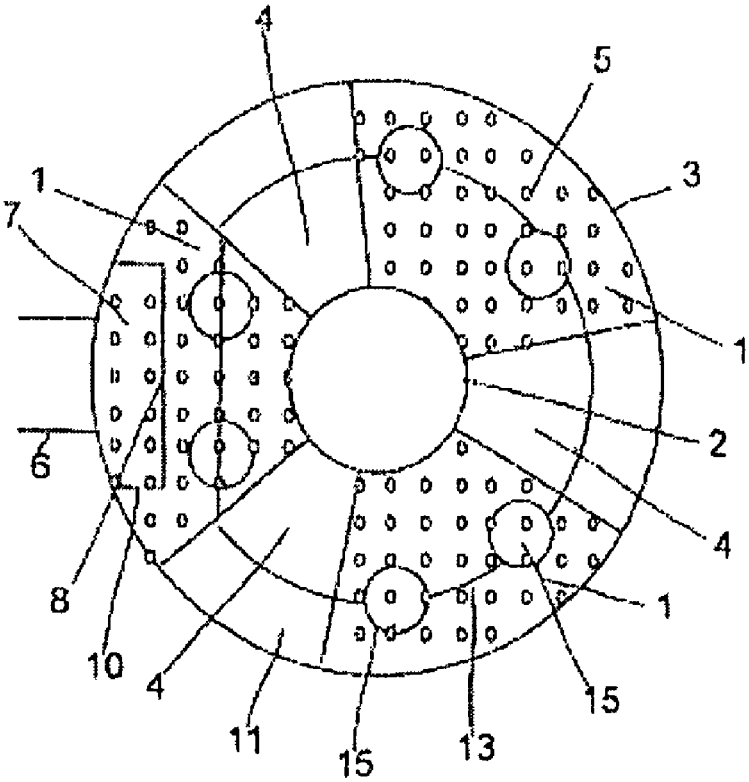

The invention relates to a rolled heat exchanger with several pipes that are wound around a central pipe, with a casing that delimits an external space around the pipes and with a liquid distributor for distributing liquid in the external space.

In LNG Baseload Plants, natural gas is continuously liquefied in large amounts. The liquefaction of the natural gas is carried out in most cases by heat exchange with a coolant in rolled heat exchangers.

In a rolled heat exchanger, several layers of pipes are wound around a central pipe. A medium, which enters into heat exchange with a medium that flows into the space between the pipes and a surrounding casing, is conveyed by the individual pipes. The pipes are merged into several groups on the upper end of the heat exchanger and are drawn out from the external space in the form of bundles.

The distribution of the liquid, which is used as a coolant, in the external space of the pipes is carried out via the liquid distributor. For this purpose, perforated-base distributors are frequently used in the prior art. With this distributor type, the liquid that is to be distributed is applied to a ring channel via a feed, which extends on the edge of the external space over its entire periphery. Below the ring channel and starting from the central pipe, several perforated bases, which are closed in each case with walls on their edges, are arranged in the shape of pie slices. The intermediate space between the individual perforated-base elements is designed to allow the pipe bundle to pass through and to allow gas to pass. The ring channel is provided with openings, for example in the form of overflows, through which the liquid flows to the individual perforated bases, which can be connected on the liquid side, and drops of the liquid further fall through the holes in the perforated base onto the pipes located thereunder.

The amount of liquid that falls onto the pipes in droplet form is determined by the hydrostatic pressure and thus by the liquid level in the perforated base. To ensure a uniform flow in all holes, a specific minimum liquid level is necessary. This produces relatively large amounts of liquid in the individual perforated bases, so that the latter and the corresponding support arms must be made very stable and are correspondingly costly and difficult to manufacture. Moreover, in the case of load changes in which the amount or composition of the fluid that flows through the pipes is varied and changes the coolant requirement, relatively large amounts of liquid must be altered, by which high inertia of the system is induced.

The object of the invention is therefore to develop a heat exchanger of the initially-mentioned type, in which the described drawbacks are avoided and a uniform distribution of the liquid in the heat exchanger pipes is achieved.

This object is achieved by a rolled heat exchanger with several pipes that are wound around a central pipe, with a casing that delimits an external space around the pipes and with a liquid distributor for distributing liquid in the external space, in which, according to the invention, the liquid distributor is designed as a pipe manifold that has a main channel and several distributing arms that are flow-connected to the main channel.

According to the invention, the liquid distributor is designed as a pipe manifold, which has a main channel that acts as a feed pipe and distributing arms that branch off from the latter. The distributing arms overlap a portion of the cross-sectional surface area above the pipes that are wound around the central pipe and are closed on all sides. Openings through which the liquid can exit and can fall onto the pipes in droplet form are found only on the underside of the distributing arms.

The distribution of the liquid according to the invention is carried out in contrast to the known systems via a closed distributor. This has the great advantage that the hydrostatic pressure that is necessary for a uniform distribution of the liquid is produced only by the liquid that is present in the main channel. The liquid content of the distributor is thus considerably lower than in the known perforated-base distributors. The total weight of the liquid distributor is significantly lowered, by which economical anchoring devices can be used. Based on its low weight, the distributor can also be adjusted more precisely than conventional distributors. Moreover, with load changes, only the liquid level in the main channel has to be matched, by which a new stationary level can be set within a short time.

By the design according to the invention, it is further ensured that the distributor can also be used on moved platforms and ground sections, since the preliminary pressure can be increased without increasing the liquid content significantly.

It has proven especially advantageous to let the main channel move within the central pipe or a portion of the central pipe or to use a portion of the central pipe as a main channel. In this way, optimum use is made of the space available within the casing of the heat exchanger.

Depending on the size and design of the central pipe, it is advantageous to select the inside diameter of the main channel in a smaller size than the inside diameter of the central pipe. Preferably, an inside pipe that is used as a main channel of the liquid distributor is introduced into the central pipe. Since the hydrostatic pressure in the distributing arms depends only on the height of the liquid level in the main channel, the liquid content of the distributor can be further reduced by a reduction of the main channel cross-section without affecting the hydrostatic pressure and thus the distributing materials.

The distributing arms preferably run radially outward starting from the main channel and are arranged perpendicular to the central pipe, so that they are aligned horizontally in the operation-ready position of the heat exchanger.

The casing that surrounds the heat exchanger is often made cylindrically. In this case, it is advantageous to form the distributing arms in the shape of pie slices.

If fluid-engineering concerns so dictate, it has proven advantageous to reduce the height of the distributing arm in radial direction from the inside outward. In this connection, "height" is defined as the expansion of the distributing arms in the direction of the central pipe axis. By corresponding reduction of the distributing arm height, the increase in the distributing arm cross-sections that otherwise occurs when the distributing arms are designed in the shape of pie slices, relative to the amount of liquid that passes through, can be compensated for or even overcompensated for if fluid-engineering concerns so dictate.

A device for reducing the kinetic energy of the incoming liquid is advantageously provided in the main channel. The liquid that is fed via the main channel is reduced, so that liquid turbulences are minimized upon entering the distributing arms. Gas that is entrained by the liquid can rise against the liquid flow and can escape through the central pipe or a separate ventilation means. Essentially only liquid and no gas are found in the distributing arms.

The device for reducing the kinetic energy of the incoming liquid is in this case preferably arranged on the lower end of the joints between the main channel and the distributing arms. A perforated plate, a static mixer or an ordered packing have proven to be especially suitable "energy brakes."

It has also proven advantageous to provide filter devices to filter possible contaminants, which could lead to a clogging of the drain openings, from the liquid to be distributed. Such filters preferably are arranged in the feed or in the main channel.

Figure 2:
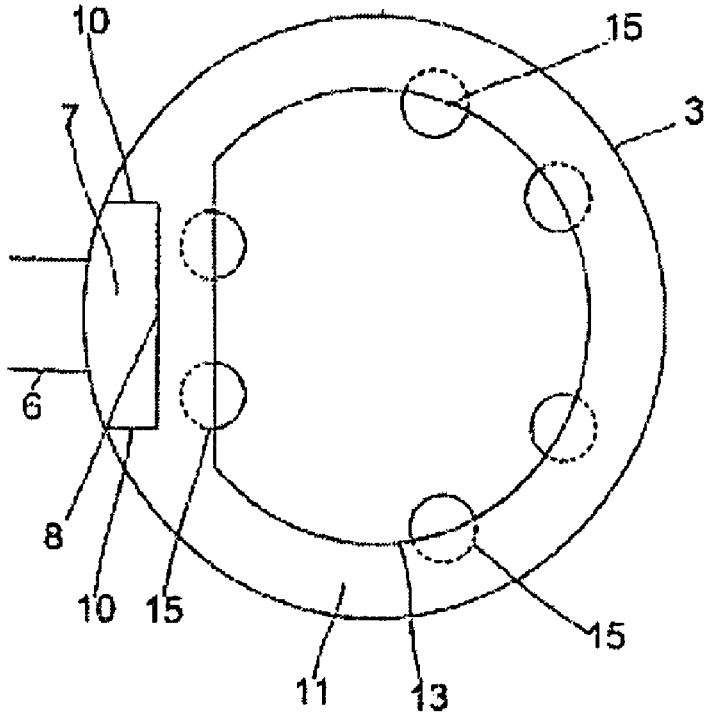
Figure 3:
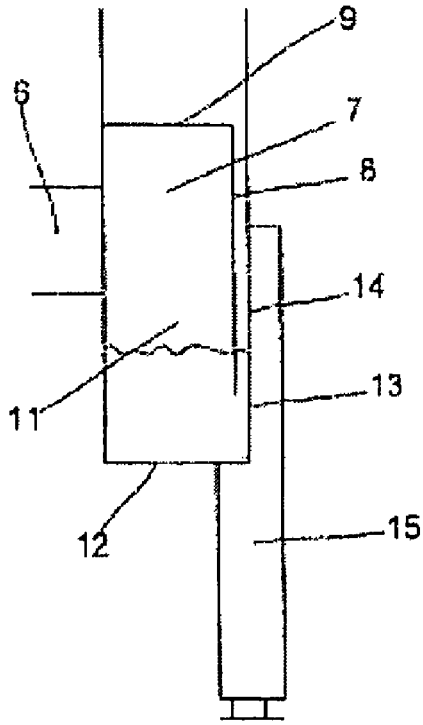
Figure 6:
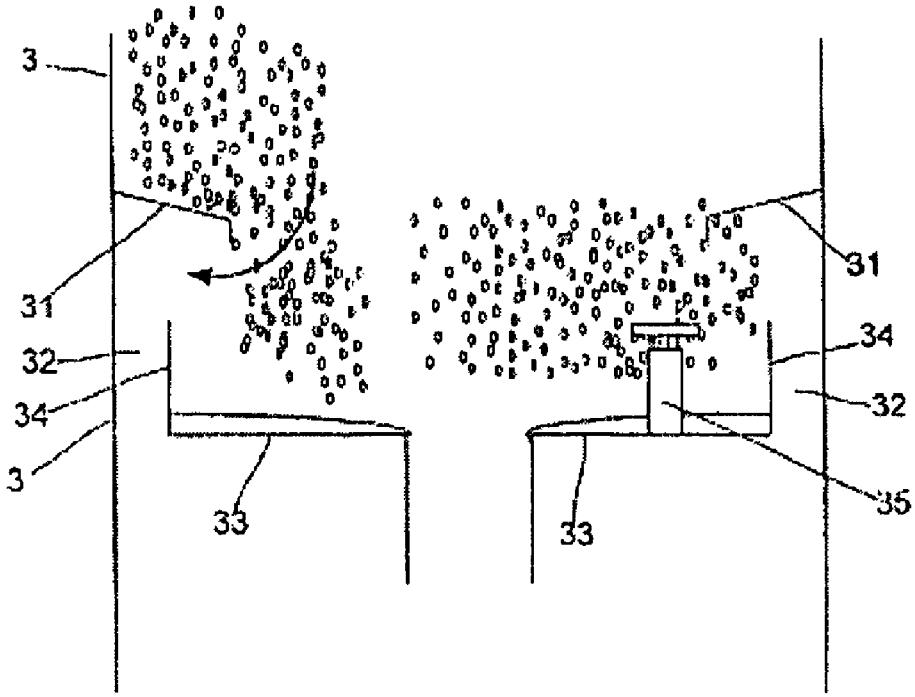
Figure 4:
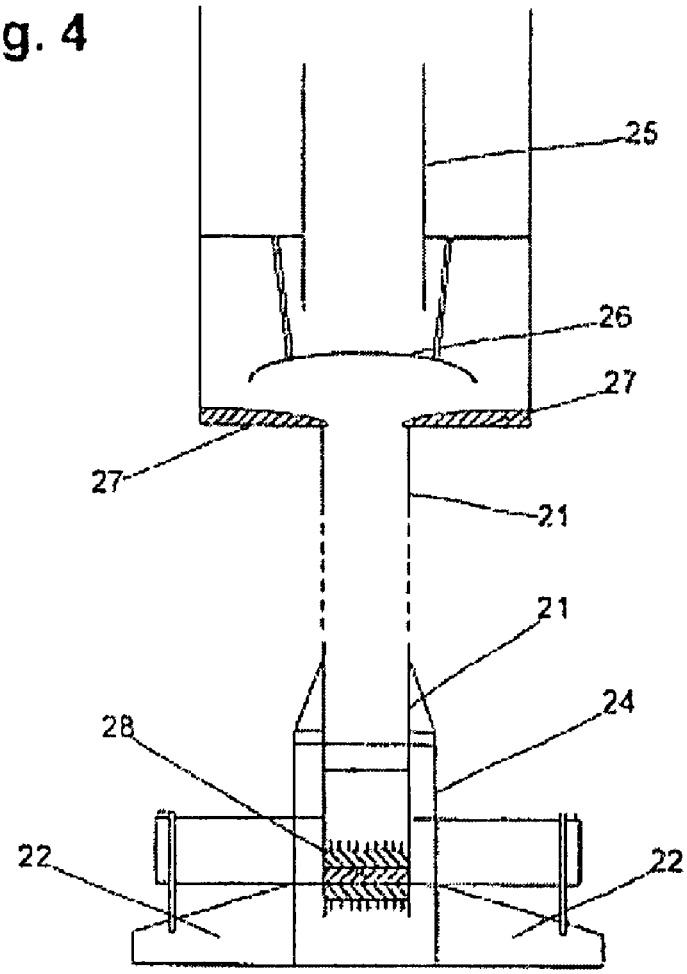
Figure 5:
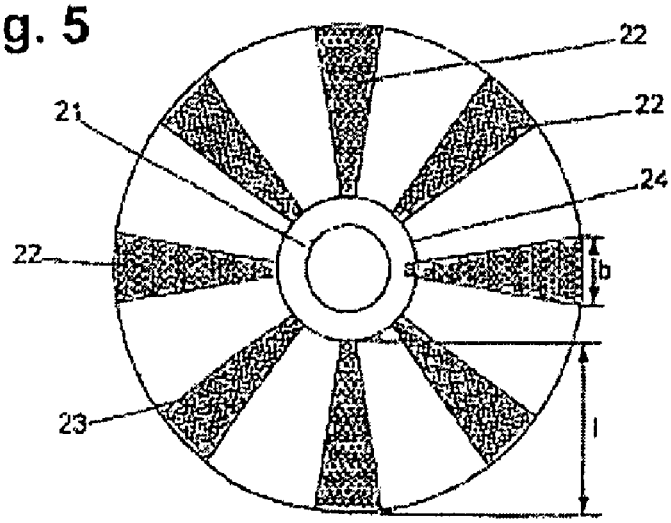

The invention as well as additional details of the invention are explained in more detail below based on the embodiments that are depicted diagrammatically in the drawings. In this connection:

FIG. 1 shows a perforated-base distributor according to the prior art,

FIG. 2 shows the top view of a ring pre-distributor, as it is used in connection with the perforated-base distributor shown in FIG. 1, FIG. 3 shows the side view of the ring pre-distributor according to FIG. 2, FIG. 4 shows the side view of a pipe manifold according to the invention, FIG. 5 shows the underside of the distributor according to FIG. 4, and FIG. 6 shows a collecting pot for an intermediate distributor.

Figure 7:
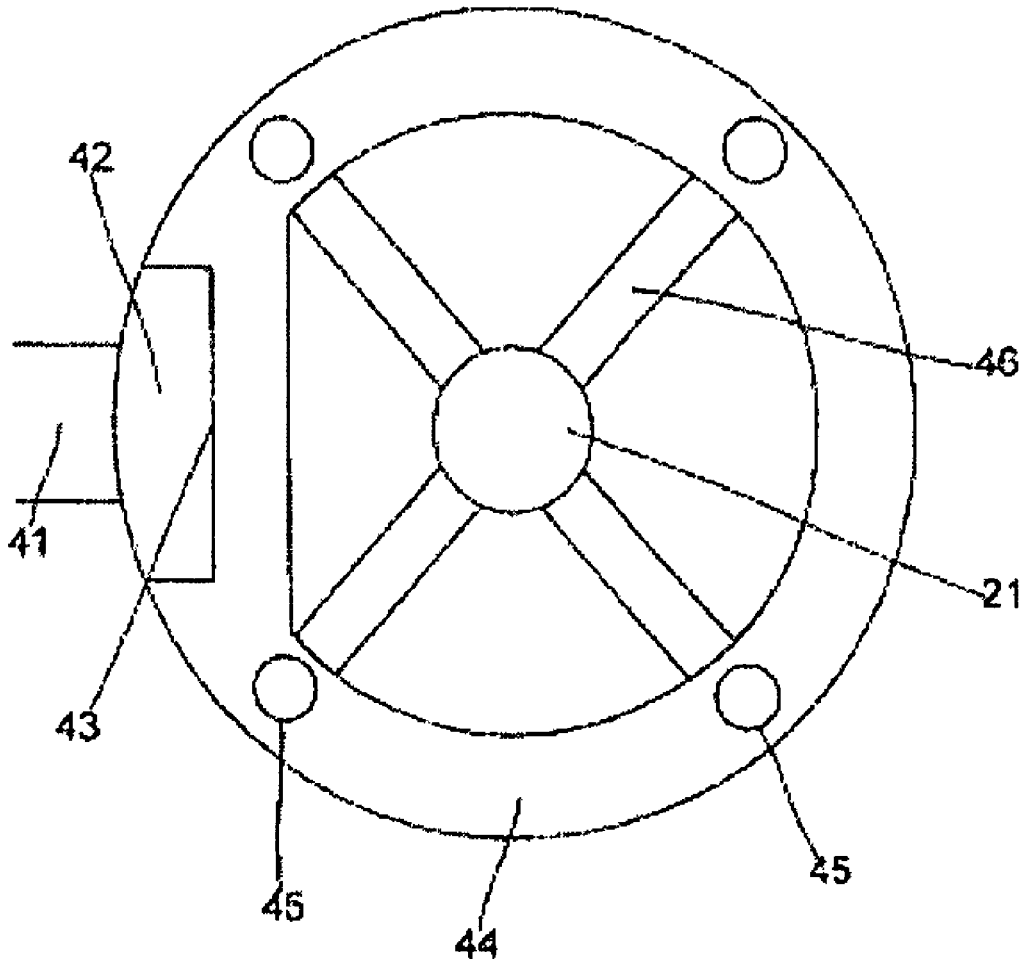

FIG. 7 shows a ring pre-distributor, which can be used in combination with the pipe manifold according to the invention.

In FIG. 1, the top view of a conventional liquid distributor for a rolled heat exchanger is shown, which is used, for example, as a liquefier in an LNG Baseload Plant. The liquid distributor has three perforated bases 1 that are in the shape of pie slices and that are arranged uniformly around the central pipe 2 of the heat exchanger and extend up to the cylindrical casing 3 of the heat exchanger. A number of pipes, which are guided through the distributor in the open areas 4 between the individual perorated bases 1, are wound on the central pipe 2.

The perforated bases 1 are provided with a number of drain openings 5, through which drops of the liquid that are found on the perforated base 1 can be added to the subjacent pipe bundle.

The feeding of the liquid is carried out via a ring pre-distributor, as it is depicted diagrammatically in FIGS. 2 and 3. The ring pre-distributor has a lateral liquid feed 6 that flows into a sturdy box 7. The side 8 of the sturdy box 7 that faces the central pipe as well as its topside 9 are closed. The sturdy box 7 is open on the side 10 and the bottom, however.

The liquid that is fed through the feed 6 enters into the sturdy box 7, strikes the wall 8, and flows downward. Entrained gas leaves the sturdy box 7 via the open sides 10. In addition to the deflection of the liquid into the ring pre-distributor, a gas-liquid separation also takes place in the sturdy box 7.

The ring pre-distributor itself consists of a ring channel 11, running along the casing 3, which is bound by the casing 3, a base 12, and a cylindrical inside wall 13. The wall 8 of the sturdy box 7 projects into the interior of the ring channel 11, such that the liquid that runs from the sturdy box 7 collects in the ring channel 11.

In the inside wall 13 of the ring channel 11, there are openings 14, through which the liquid can enter into the drain pipes 15, which are arranged above the perforated bases 1. Consequently, the fed liquid is uniformly distributed by the ring pre-distributor over the periphery of the heat exchanger, such that all perforated bases 1 are supplied as much as possible with the same amount of liquid. The actual distribution of the liquid to the wound pipe bundle is then carried out by means of the perforated bases 1.

As already mentioned, this known embodiment must be made very stable based on the heavy liquid load on the perforated bases 1 and requires expensive anchoring devices.

In FIGS. 4 and 5, the primary structure of a liquid distributor according to the invention is shown. According to the invention, the liquid distributor is designed as a pipe manifold. The pipe manifold comprises a main channel 21 and distributing arms 22 that are connected to the latter.

In FIG. 5, the base area of the distributing arms 22 in the shape of pie slices can be seen clearly. The size of the distributing arms 22, i.e., the length of the sides a, b that bound the distributing arms 22 as well as the length 1 of the distributing arms 22, depends on the space required for guiding the pipe bundle and the gas between the distributing arms 22 as well as the density and arrangement of the pipe bundle that is to be sprinkled with water.

The height of the distributing arms 22 decreases linearly in radial direction, as shown in FIG. 4. This embodiment of the distributing arms 22 entails a more homogenous distribution of the liquid and is used in the reduction of the liquid content and thus the operating weight.

On their underside, the distributing arms 22 have a number of openings 23, through which the liquid can drop onto the subjacent pipes. The density of the openings 23 is not constant in radial direction but rather is matched to the subjacent pipe bundle surface that is to be sprinkled with water.

If fluid-engineering concerns so dictate, the openings 23 are not designed to go through the entire wall thickness of the distributing arms 22 with the same cross-section. Either from the outside or from the inside of the distributing arms 22, the openings 23 are provided with a larger hole, which does not extend, however, via the total wall thickness of the distributing arms 22. In this way, the effective wall thickness in the area of the openings 23 is reduced, by which a more uniform discharge of the liquid is achieved.

The main channel 21 is formed by an inside pipe that is arranged in the central pipe 24. The feeding of the liquid to be distributed or a liquid-gas mixture is carried out via a perpendicular feeder 25. On the lower outlet end of the feeder 25, a baffle plate 26 is attached, which the incoming liquid or the liquid-gas mixture strikes. The liquid then runs along the baffle plate 26, curved downward, laterally into a collecting pot 27, which conveys the liquid into the inside pipe 21.

When the liquid drains from the baffle plate 26 and the collecting pot 27, gas that is flushed with the liquid via the feeder 25 into the heat exchanger escapes. The gas is drawn off via the ring-shaped external space between the feeder 25 and the casing 3 of the heat exchanger, such that essentially liquid enters into the inside pipe 21.

On the lower end of the main channel 21, there is an ordered packing 28, which is used as an energy brake for the dropping liquid. Moreover, filter devices can be attached to the energy brakes 28 upstream or downstream.

In FIG. 6, a liquid collector is shown, which can be used, for example, for collecting liquid, which falls from a subjacent pipe bundle in droplet form and/or is released from outside or laterally and is to be conveyed in a subjacent liquid distributor according to the invention.

A ring-shaped runoff plate 31 that tilts downward is attached to the outside casing 3, and said plate directs the liquid to be sprinkled onto the pipes, not shown, from the edge into the center. Instead of the tilted runoff plate 31 that is shown, a horizontal ring-shaped plate can also be used. In this case, it is advantageous if on its edge that faces away from the outside casing 3, the horizontal plate is equipped with a perpendicular weir that has outlets for the liquid. Gas passages 32 are found below the runoff plate 31. The runoff plate 31 projects to the extent that liquid that falls from above in droplet form cannot enter into the gas passages 32; by contrast, gas that is present takes the path through the gas passage 32 that is indicated by the arrow.

The liquid that runs off from the runoff plate 31 strikes a collecting pot 33, which is bound by a lateral wall 34, which in turn is bound by the gas passage 32. In addition, the collecting pot 33 has another gas passage 35. From the collecting pot 33, the liquid further flows into the main channel 21 of a pipe manifold, as it is shown in FIGS. 4 and 5.

If the liquid is fed via a feed line 41 laterally to the heat exchanger, a ring pre-distributor, as it is shown in FIG. 7, has proven its value. The ring pre-distributor that is shown in FIG. 7 is designed similar to that shown in FIG. 2. The liquid is fed via pipe 41 from the side, goes into a sturdy box 42, strikes the wall 43 and flows downward. In this connection, as indicated in connection with FIG. 2, a first separation of liquid and gas takes place.

The liquid then collects in the ring channel 44. In the bottom of ring channel 44, drain openings 45, to which pipe pieces 46—which connect the ring channel 44 to the main channel 21 of a pipe manifold according to the invention corresponding to the FIGS. 4 and 5—are connected, are found.

The pre-distributor, shown in FIGS. 2 and 3, can also be used as a pre-distributor for the pipe manifold according to the invention. For this purpose, only the drain pipes 15 must be connected to the main channel 21.

The invention claimed is:

1. Heat exchanger with several pipes that are wound around a central pipe, with a casing that delimits an external space around the pipes and with a liquid distributor for distributing liquid in the external space, characterized in that the liquid distributor is designed as a pipe manifold that has a main channel (21) and several distributing arms (22) that are flow-connected to the main channel (21) and have liquid outlets (23) positioned on their underside, wherein the distributing arms (22), starting from the main channel (21), run radially outward and the height of the distributing arms (22) decreases in radial direction.

2. Heat exchanger with several pipes that are wound around a central pipe, with a casing that delimits an external space around the pipes and with a liquid distributor for distributing liquid in the external space, characterized in that the liquid distributor is designed as a pipe manifold that has a main channel (21) and several distributing arms (22) that are flow-connected to the main channel (21) and have liquid outlets (23) positioned on their underside wherein a device (28) for reducing the kinetic energy of the incoming liquid is provided in the main channel (21).

3. Heat exchanger with several pipes that are wound around a central pipe, with a casing that delimits an external space around the pipes and with a liquid distributor for distributing liquid in the external space, characterized in that the liquid distributor is designed as a pipe manifold that has a main channel (21) and several distributing arms (22) that are flow-connected to the main channel (21) and have liquid outlets (23) positioned on their underside wherein a perforated plate, a static mixer or an ordered packing (28) is provided to reduce the kinetic energy of the incoming liquid.

4. Rolled heat exchanger with several pipes that are wound around a central pipe, with a casing that delimits an external space around the pipes and with a liquid distributor for distributing liquid in the external space, whereby the liquid distributor is designed as a pipe manifold that has a main channel (21) and several distributing arms (22) that are flow-connected to the main channel (21), characterized by at least one of the two following additional features:

a perforated plate, a static mixer or an ordered packing (28) arranged in the main channel (21), to reduce the kinetic energy of the incoming liquid, or the distributing arms (22) form a cavity in the shape of pie slices.

5. Heat exchanger according to claim 4, characterized in that in the main channel (21), both a perforated plate, a static mixer or an ordered packing (28) for reducing the kinetic energy of the incoming liquid is provided and the distributing arms (22) form a cavity in the shape of pie slices.

6. Heat exchanger according to claim 4, wherein the main channel (21) runs inside a portion of the central pipe (24).

7. Heat exchanger according to claim 6, wherein the inside diameter of the main channel (21) is smaller than the inside diameter of the central pipe (24).

8. Heat exchanger according to claim 4, wherein the distributing arms (22), starting from the main channel (21), run radially outward.

9. Heat exchanger according to claim 8, wherein the height of the distributing arms (22) decreases in radial direction.

10. Heat exchanger according to claim 4, wherein the distributing arms (22) have liquid outlets (23), whereby the density of the liquid outlets (23) changes in radial direction.

* * * * *